US011116260B2

(12) United States Patent
Kally

(10) Patent No.: US 11,116,260 B2
(45) Date of Patent: Sep. 14, 2021

(54) BRA STRAP ORNAMENT ASSEMBLY

(71) Applicant: Cherian Kally, Ocala, FL (US)

(72) Inventor: Cherian Kally, Ocala, FL (US)

( * ) Notice: Subject to any disclaimer, the term of this patent is extended or adjusted under 35 U.S.C. 154(b) by 96 days.

(21) Appl. No.: 16/747,234

(22) Filed: Jan. 20, 2020

(65) Prior Publication Data

US 2021/0219629 A1 Jul. 22, 2021

(51) Int. Cl.
*A41C 3/00* (2006.01)

(52) U.S. Cl.
CPC ..... *A41C 3/0078* (2013.01)

(58) Field of Classification Search
CPC ..... A41C 3/0078; A41F 15/02
USPC ..... 450/82, 86
See application file for complete search history.

(56) References Cited

U.S. PATENT DOCUMENTS 3,848,270 A * 11/1974 Rand ..... A41F 9/002 2/311
4,941,237 A * 7/1990 Hovis ..... A41F 9/00 2/319
5,172,428 A * 12/1992 Leinoff ..... A41D 5/00 2/181
5,309,608 A * 5/1994 Lucas ..... A41F 15/02 24/304
5,626,507 A * 5/1997 Gillen ..... A41C 3/105 2/268
5,852,829 A * 12/1998 Relaford ..... A41F 9/002 2/338
5,914,166 A * 6/1999 Le ..... A41F 15/02 428/40.1
6,282,725 B1 9/2001 Vanidestine, Jr.
7,833,085 B2 * 11/2010 Crouch ..... A41F 15/02 450/86
8,357,025 B2 1/2013 Brydon
8,469,772 B2 * 6/2013 Crouch ..... A41F 15/00 450/86
8,808,058 B2 * 8/2014 Crouch ..... A41F 15/002 450/86
9,173,440 B1 * 11/2015 Crouch ..... A41F 15/02
9,743,693 B2 * 8/2017 Zambelli ..... A41C 3/08
2009/0117826 A1 * 5/2009 Crouch ..... A41F 15/02 450/86
2009/0258572 A1 10/2009 Chayo
2012/0028539 A1 * 2/2012 McCarty ..... A41F 1/006 450/1
2012/0324631 A1 * 12/2012 Peper ..... A41F 15/00 2/244
2013/0254977 A1 * 10/2013 Crouch ..... A41F 15/002 2/338

* cited by examiner

*Primary Examiner* — Gloria M Hale

(57) ABSTRACT

A bra strap ornament assembly includes a panel that has a concealed side and an exposed side. The panel is positionable to extend across a torso strap of a strapless brassiere having the exposed side being exposed to conceal the torso strap. A pair of belts is each coupled to the panel. Each of the belts is matable to themselves to form a closed loop thereby facilitating each of the belts to be secured around the torso strap of the strapless brassiere. A pair of hooks is each coupled to a respective one of the belts. Each of the hooks releasably engages the respective belt when the respective belt is wrapped around the strap of the brassiere for tightening the belt around the strap.

7 Claims, 6 Drawing Sheets

BRA STRAP ORNAMENT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to ornament devices and more particularly pertains to a new ornament device for concealing the torso strap of a strapless brasserie.

(2) Description of Related Art Including Information Disclosed Under 37 CFR 1.97 and 1.98

The prior art relates to ornament devices. The prior art discloses a modular brasserie that can be assembled or disabled in a variety of configurations.

BRIEF SUMMARY OF THE INVENTION

An embodiment of the disclosure meets the needs presented above by generally comprising a panel that has a concealed side and an exposed side. The panel is positionable to extend across a torso strap of a strapless brassiere having the exposed side being exposed to conceal the torso strap. A pair of belts is each coupled to the panel. Each of the belts is matable to themselves to form a closed loop thereby facilitating each of the belts to be secured around the torso strap of the strapless brassiere. A pair of hooks is each coupled to a respective one of the belts. Each of the hooks releasably engages the respective belt when the respective belt is wrapped around the strap of the brassiere for tightening the belt around the strap.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
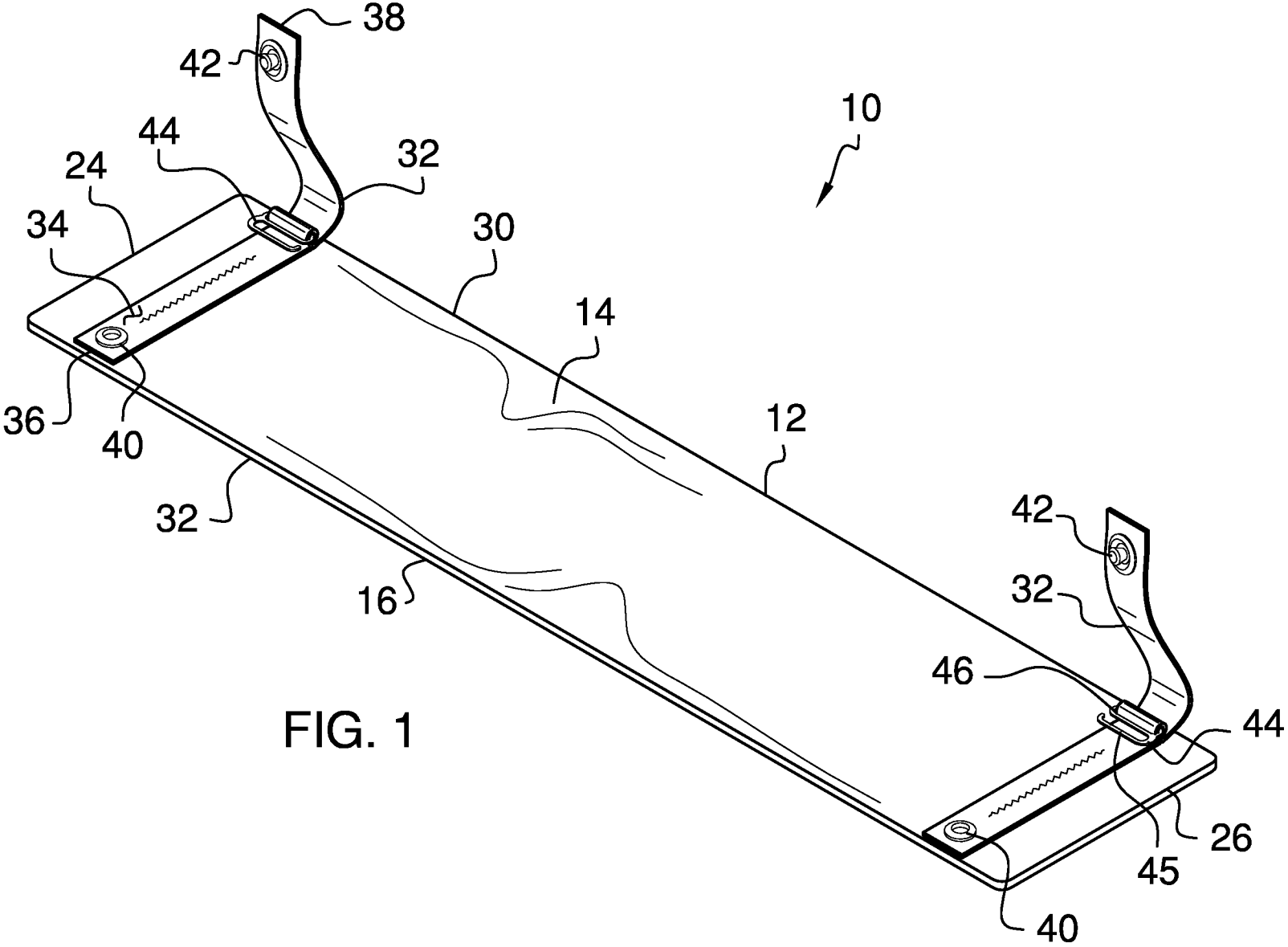
FIG. 1 is a top perspective view of a bra strap ornament assembly according to an embodiment of the disclosure.
Figure 2:
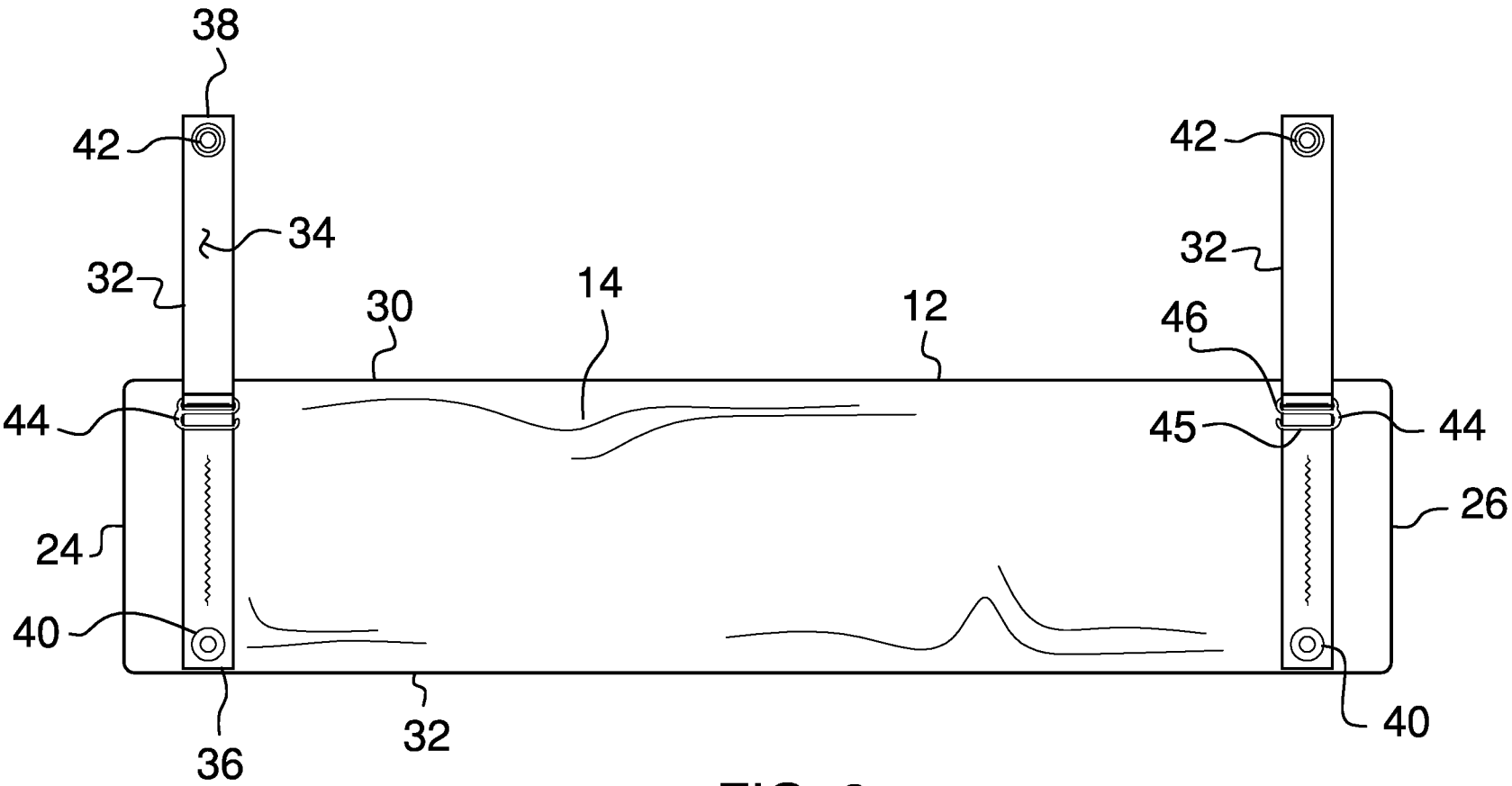
FIG. 2 is a top view of an embodiment of the disclosure.
Figure 3:
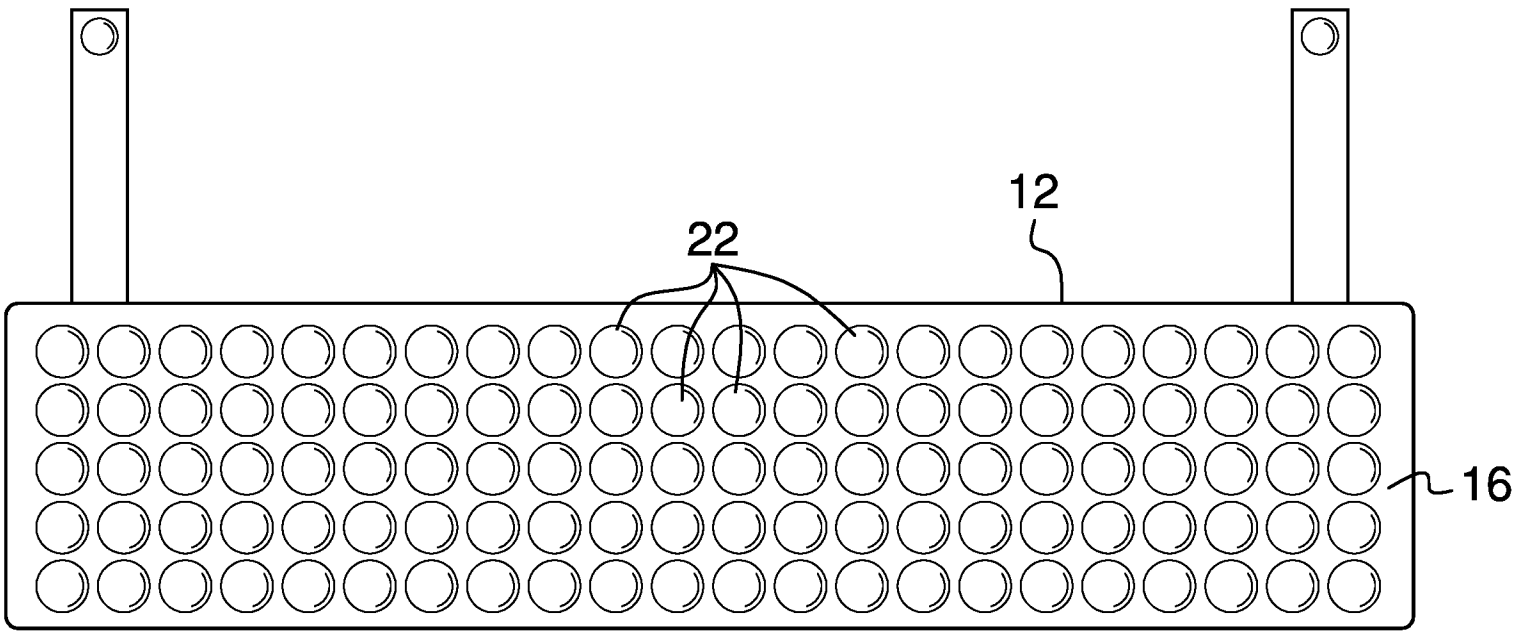
FIG. 3 is a bottom view of an embodiment of the disclosure.
Figure 4:
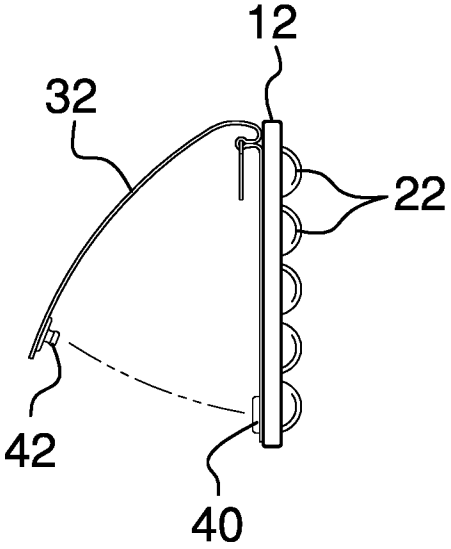
FIG. 4 is a right side view of an embodiment of the disclosure.
Figure 5:
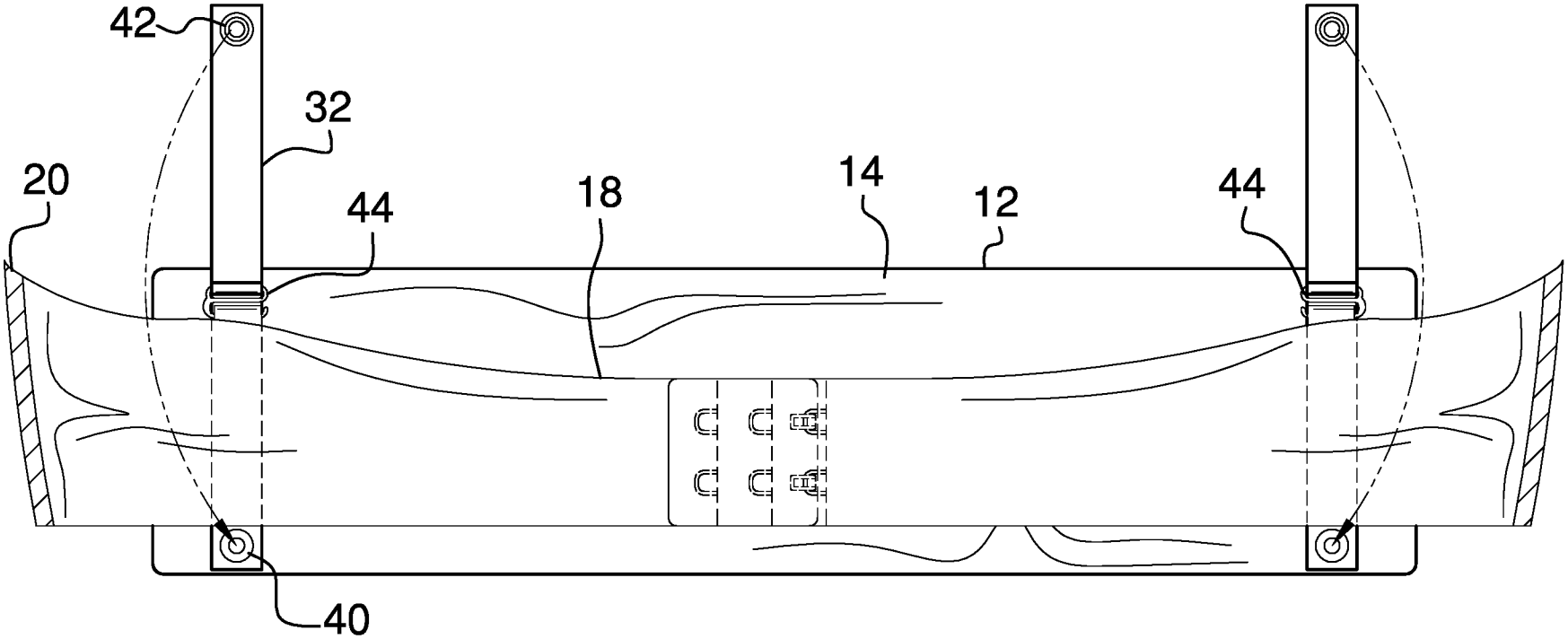
FIG. 5 is an in-use view of an embodiment of the disclosure.
Figure 6:
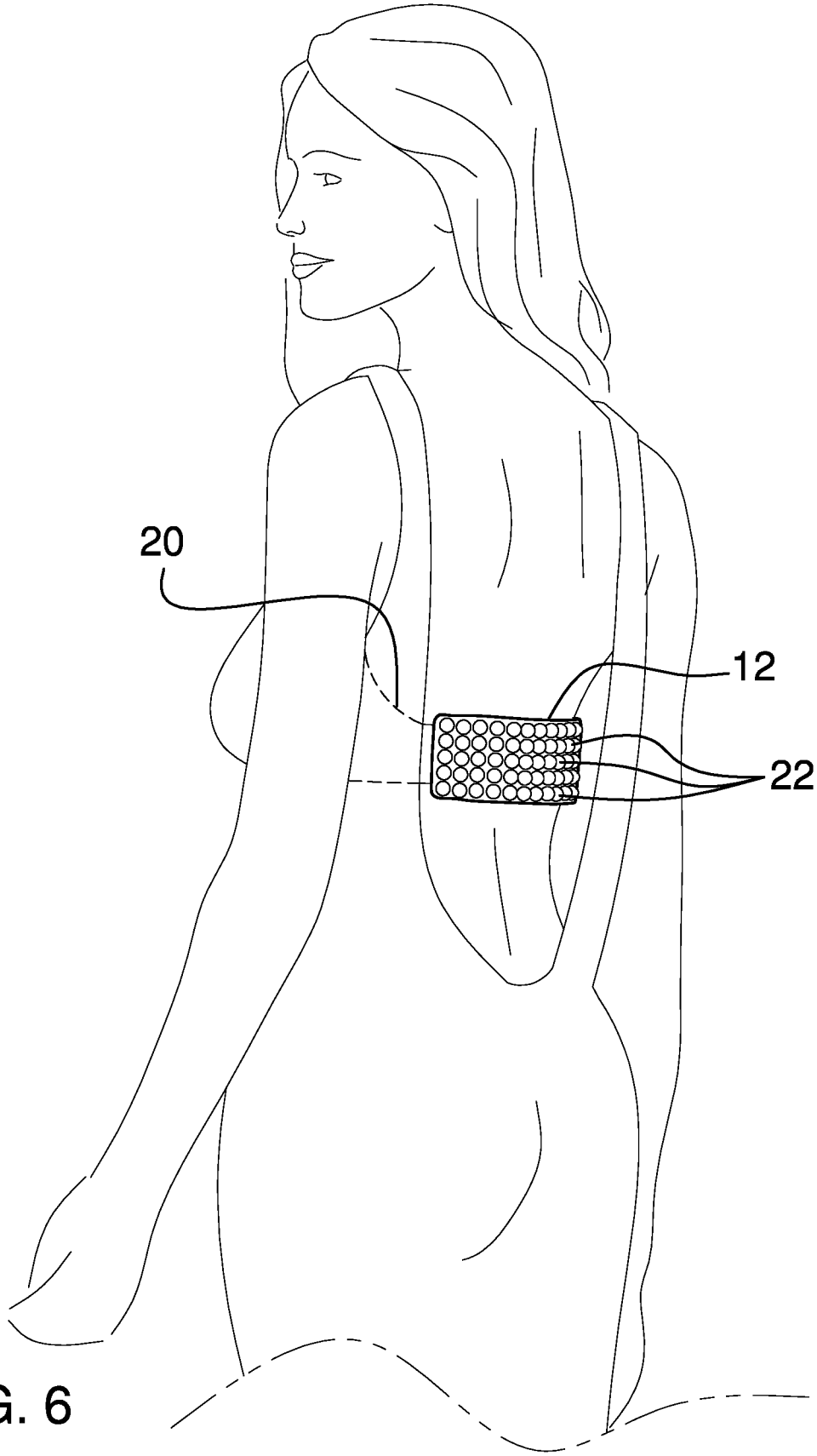
FIG. 6 is a perspective in-use view of an embodiment of the disclosure.

With reference now to the drawings, and in particular to FIGS. 1 through 6 thereof, a new ornament device embodying the principles and concepts of an embodiment of the disclosure and generally designated by the reference numeral 10 will be described.

As best illustrated in FIGS. 1 through 6, the bra strap ornament assembly 10 generally comprises a panel 12 that has a concealed side 14 and an exposed side 16. The panel 12 is positionable to extend across a torso strap 18 of a strapless brassiere 20 having the exposed side 16 being exposed. In this way the panel 12 conceals the torso strap 18 when the strapless brassiere 20 is worn with a dress that would normally expose the torso strap 18. The exposed side 16 has a plurality of ornamental features 22 thereon for enhancing the ornamental appeal of the panel 12. The panel 12 has a first end 24, a second end 26, a front edge 28 and a back edge 30, and the panel 12 is elongated between the first end 24 and the second end 26.

A pair of belts 32 is each coupled to the panel 12. Each of the belts 32 is matable to themselves to form a closed loop thereby facilitating each of the belts 32 to be secured around the torso strap 18 of the strapless brassiere 20. Each of the belts 32 has a top surface 34, a primary end 36 and a secondary end 38, and each of the belts 32 is positioned on the concealed side 14 of the panel 12. Each of the belts 32 extends from the front edge 28 of the panel 12 beyond the back edge 30 of the panel 12 such that the secondary end 38 of each of the belts 32 is free.

A pair of first mating members 40 is each coupled to the top surface 34 of a respective one of the belts 32. Each of the first mating members 40 is positioned adjacent to the primary end 36 of the respective belt 32. A pair of second mating members 42 is each coupled to the top surface 34 of a respective one of the belts 32. Each of the second mating members 42 is positioned adjacent to the secondary end 38 of the respective belt 32. Each of the second mating members 42 releasably engages the first mating members 40 for mating the belts 32 to themselves. Additionally, each of the first mating members 40 and the second mating members 42 may comprise snaps or other type of releasable fastener.

A pair of hooks 44 is provided and each of the hooks 44 is coupled to a respective one of the belts 32. Each of the hooks 44 releasably engages the respective belt 32 when the respective belt 32 is wrapped around the torso strap 18 of the brassiere 20 for tightening the belt 32 around the torso strap 18. Each of the hooks 44 is positioned at a point located adjacent to the back edge 30 of the panel 12 and each of the hooks 44 is positioned on the top surface 34 of the respective belt 32.

Each of the hooks 44 includes a finger 45 that is spaced from a coupling 46. The coupling 46 of each of the hooks 44 movably engages the respective belt 32. The respective belt 32 is slid between the finger 45 and the coupling 46 when the respective belt 32 is mated to itself. In this way each of the belts 32 is tightened around the torso strap 18 of the strapless brassiere 20. The hooks 44 are oriented having the finger 45 on each of the hooks 44 being directed toward each other.

In use, the panel 12 is positioned on the torso strap 18 when the brassiere 20 is being worn and each of the belts 32 is laid across the torso strap 18. The first mating member 40 on each belt 32 is mated to the second mating member 42 on the belt 32 to attach the panel 12 to the torso strap 18. Additionally, each belt 32 is extended through the respective hook 44 for tightening the belt 32 on the torso strap 18. In this way the ornamental features 22 on the panel 12 are visible when the dress is worn, rather than having the torso strap 18 being visible.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bra strap ornament assembly being configured to conceal a strap of a strapless bra, said assembly comprising:

a panel having a concealed side and an exposed side, said panel being positionable to extend across a torso strap of a strapless brassiere having said exposed side being exposed wherein said panel is configured to conceal the torso strap, said exposed side having a plurality of ornamental features thereon for enhancing the ornamental appeal of said panel;

a pair of belts, each of said belts being coupled to said panel, each of said belts being matable to themselves to form a closed loop thereby facilitating each of said belts to be secured around the torso strap of the strapless brassiere; and a pair of hooks, each of said hooks being coupled to a respective one of said belts, each of said hooks releasably engaging said respective belt when said respective belt is wrapped around the strap of the brassiere for tightening said belt around the strap.

2. The assembly according to claim 1, wherein:

said panel has a first end, a second end, a front edge and a back edge, said panel being elongated between said first end and said second end; and each of said belts has a top surface, a primary end and a secondary end, each of said belts being positioned on said concealed side of said panel, each of said belts extending from said front edge of said panel beyond said back edge of said panel such that said secondary end of each of said belts is free.

3. The assembly according to claim 2, further comprising a pair of first mating members, each of said first mating members being coupled to said top surface of a respective one of said belts, each of said first mating members being positioned adjacent to said primary end of said respective belt.

4. The assembly according to claim 3, further comprising a pair of second mating members, each of said second mating members being coupled to said top surface of a respective one of said belts, each of said second mating members being positioned adjacent to said secondary end of said respective belt, each of said second mating members releasably engaging said first mating members for mating said belts to themselves.

5. The assembly according to claim 2, wherein each of said hooks is positioned at a point located adjacent to said back edge of said panel, each of said hooks being positioned on said top surface of said respective belt.

6. The assembly according to claim 5, wherein each of said hooks includes a finger being spaced from a coupling, said coupling of each of said hooks movably engaging said respective belt, said respective belt being slid between said finger and said coupling when said respective belt is mated to itself, said hooks being oriented having said finger on each of said hooks being directed toward each other.

7. A bra strap ornament assembly being configured to conceal a strap of a strapless bra, said assembly comprising:

a panel having a concealed side and an exposed side, said panel being positionable to extend across a torso strap of a strapless brassiere having said exposed side being exposed wherein said panel is configured to conceal the torso strap, said exposed side having a plurality of ornamental features thereon for enhancing the ornamental appeal of said panel, said panel having a first end, a second end, a front edge and a back edge, said panel being elongated between said first end and said second end;

a pair of belts, each of said belts being coupled to said panel, each of said belts being matable to themselves to form a closed loop thereby facilitating each of said belts to be secured around the torso strap of the strapless brassiere, each of said belts having a top surface, a primary end and a secondary end, each of said belts being positioned on said concealed side of said panel, each of said belts extending from said front edge of said panel beyond said back edge of said panel such that said secondary end of each of said belts is free;

a pair of first mating members, each of said first mating members being coupled to said top surface of a respective one of said belts, each of said first mating members being positioned adjacent to said primary end of said respective belt;

a pair of second mating members, each of said second mating members being coupled to said top surface of a respective one of said belts, each of said second mating members being positioned adjacent to said secondary end of said respective belt, each of said second mating members releasably engaging said first mating members for mating said belts to themselves; and a pair of hooks, each of said hooks being coupled to a respective one of said belts, each of said hooks releasably engaging said respective belt when said respective belt is wrapped around the strap of the brassiere for tightening said belt around the strap, each of said hooks being positioned at a point located adjacent to said back edge of said panel, each of said hooks being positioned on said top surface of said respective belt, each of said hooks including a finger being spaced from a coupling, said coupling of each of said hooks movably engaging said respective belt, said respective belt being slid between said finger and said coupling when said respective belt is mated to itself, said hooks being oriented having said finger on each of said hooks being directed toward each other.

* * * * *